US010578366B2

(12) United States Patent
Shea

(10) Patent No.: US 10,578,366 B2
(45) Date of Patent: Mar. 3, 2020

(54) THERMOPLASTIC KETTLE AUXILARY MULTI-PASS OIL BATH HEAT EXCHANGER SYSTEM

(71) Applicant: James P. Shea, Waterford, MI (US)

(72) Inventor: James P. Shea, Waterford, MI (US)

( * ) Notice: Subject to any disclaimer, the term of this patent is extended or adjusted under 35 U.S.C. 154(b) by 0 days.

(21) Appl. No.: 15/971,630

(22) Filed: May 4, 2018

(65) Prior Publication Data

US 2018/0335261 A1 Nov. 22, 2018

Related U.S. Application Data

(60) Provisional application No. 62/508,473, filed on May 19, 2017.

(51) Int. Cl.

| | |
|---|---|
| ***F28D 7/16*** | (2006.01) |
| ***F28F 9/02*** | (2006.01) |
| *E01F 9/506* | (2016.01) |
| *F28D 21/00* | (2006.01) |

(52) U.S. Cl.

CPC ..... *F28D 7/1607* (2013.01); *F28F 9/0202* (2013.01); *E01F 9/506* (2016.02); *F28D 2021/0061* (2013.01)

(58) Field of Classification Search

CPC ..... E01C 23/206; F28D 7/1607; F28D 2021/0061; E01F 9/506; F28F 9/0202; F28F 27/02

See application file for complete search history.

(56) References Cited

U.S. PATENT DOCUMENTS

| | | | | | |
|---|---|---|---|---|---|
| 1,934,056 | A | * | 11/1933 | Gomory | C10G 47/00 208/107 |
| 2,049,748 | A | * | 8/1936 | Rathbun | F28D 7/1646 165/146 |
| 4,221,763 | A | * | 9/1980 | Greene | B01J 3/04 165/158 |
| 4,363,355 | A | * | 12/1982 | Prucyk | F28D 7/08 165/150 |
| 4,564,142 | A | * | 1/1986 | Cleer, Jr. | F24D 19/083 237/56 |
| 5,509,466 | A | * | 4/1996 | McQuade | F25B 39/04 165/112 |
| 6,095,803 | A | * | 8/2000 | Slater | B05C 11/1042 222/146.2 |

(Continued)

*Primary Examiner* — Steven S Anderson, II

(74) *Attorney, Agent, or Firm* — Brinks Gilson & Lione

(57) ABSTRACT

An auxiliary multi-pass tube bundle heat exchanger for improving the melting efficiency of melter kettles used to melt thermoplastic pavement marking materials. The auxiliary multi-pass tube bundle heat exchanger includes a heat transfer tube bundle having a plurality of heat transfer tubes in which the flow of molten thermoplastic material reverses directions at least once. Hot heat transfer oils flows around the plurality of heat transfer tubes. Molten thermoplastic material is pumped from the bottom of a melter kettle, through the auxiliary multi-pass tube bundle heat exchanger and to the top of the melter kettle. A drainage system is provided to drain molten thermoplastic material and any settled glass beads form the auxiliary multi-pass tube bundle heat exchanger and a purging system is provided to purge molten thermoplastic material form the auxiliary multi-pass tube bundle heat exchanger using compressed air.

11 Claims, 5 Drawing Sheets

(56) References Cited

U.S. PATENT DOCUMENTS

| | | | | |
|---|---|---|---|---|
| 6,899,169 | B1 * | 5/2005 | Cox | F28D 7/1607 165/157 |
| 2014/0262162 | A1 * | 9/2014 | Zimmer | F28D 9/0006 165/109.1 |
| 2016/0017144 | A1 * | 1/2016 | Harris | C08L 77/00 521/143 |

* cited by examiner

THERMOPLASTIC KETTLE AUXILARY MULTI-PASS OIL BATH HEAT EXCHANGER SYSTEM

RELATED APPLICATION

The present application is based on U.S. Provisional Application Ser. No. 62/508,473, filed May 19, 2017 to which priority is claimed under 35 U.S.C. § 120 and of which the entire specification is hereby expressly incorporated by reference.

BACKGROUND

The present invention relates generally to melter kettles that are designed and used to melt thermoplastic materials that are applied to pavements such as roadways, airport runways, parking lots, bicycle paths and other surfaces requiring pavement markings. More particularly the present invention is directed to systems and methods to improve the efficiency of melter kettles.

Thermoplastic materials are the product of choice for many types of pavement marking operations. However, unlike most types of marking materials thermoplastic materials must be heated to relatively high temperatures that can reach to about 420° F. to be melted and fluid enough to be applied.

Early types of thermoplastic application equipment applied the thermoplastic at slow rates. Therefore, the long melting times it took to melt thermoplastic materials in melter kettles were not a problem. Melter kettles could keep up with the slow output of application equipment.

Eventually improvements in the designs of melter kettles achieved reductions of melting times. However, over time application equipment was improved to the point at which thermoplastic material could be applied at much faster rates than the improved melter kettles could keep up with melting the thermoplastic material. The present invention increases the efficiency of melting thermoplastic in melter kettles that can be mounted on either thermoplastic application trucks, nurse trucks, trailers or the like.

For some time heat domes, also called heat risers or heat tubes, have been installed in melter kettles. The dome structure is formed by a tube of variable diameter that is attached to a hole in the base of the melter kettle where the OD of the dome base matches the ID of the hole in the base of the melter kettle. The top of the dome is closed by a metal disc. The dome reduces the heating surface area of the base. However, the dome provides additional circumference surface area that compensates for the loss of the heating area in a melter kettle with no dome and compensates for the lost surface area of the base within a few inches of dome height. From this point the dome adds melting (heat transfer) surface area to the melter kettle with a dome as compared to a melter kettle without a dome thereby increasing the overall heating surface area in the melter kettle that acts on the thermoplastic material in the melter kettle. This reduces the ratio of the thermoplastic material to melting (heat transfer) surface area of the melter kettle which improves heating efficiency.

Additionally, heating thermoplastic material in a melter kettle from the middle of the melter kettle in an outwardly direction is more efficient than heat transfer from the outside of the melter kettle in an inward direction. Heat domes have reduced melting times in melter kettles. However, heated air in the dome cools as heat transfers through the dome wall and into the thermoplastic melter kettle. Melting times are reduced with the use of domes but still need improvement.

A recent improvement in melter kettle efficiency has been developed by the present inventor and is disclosed in U.S. non-provisional application Ser. No. 15/424,451 entitled "HEAT DOME TEMPERATURE REGULATING SYSTEM," filed Feb. 3, 2017. In this copending application a heat dome chimney stack tube is attached to the top center of a heat dome about which an agitator drive shaft tube rotates. Hot combustion gasses travel from the heat dome up the center of the heat dome chimney tube stack and vent into a top tube drive shaft heat chamber that has a drive shaft tube relief vents through which combustion gasses can be regulated by providing a rotational vent relief collar about the top tube driveshaft heat chamber. This system exhausts combustion gasses from the dome that has been heat depleted thereby allowing a continual flow of hot combustion gasses to maximize/optimize efficient temperature in the dome such that the maximum amount of heat is transferred through the dome and chimney stack surface areas into the thermoplastic material in the melter kettle. In this system the heat dome chimney stack tube and rotational drive shaft become heating surfaces through the centerline of the melter kettle. This system improves the rate of thermoplastic melting.

Another recent improvement in melter kettle efficiency developed by the present inventor is disclosed in U.S. non-provisional application Ser. No. 15/424,461, entitled THERMOPLASTIC KETTLE MATERIAL CIRCULATION SYSTEM, filed Feb. 3, 2017. In this improvement a single vertical material transfer tube is affixed to the side of the thermoplastic melter kettle either directly to the melter kettle side wall or outer insulation skin. The tube is attached to ports at the bottom and top of the melter kettle and an auger rotated by a direct drive motor within the vertical transfer tube moves molten thermoplastic material from the bottom of the melter kettle to the top. When the vertical material transfer tube is connected directly to the melter kettle wall the bottom interface is within the heat chamber's outer wall.

When the vertical material transfer tube is affixed to the outer insulation skin there is an extended heat chamber surrounding the vertical material transfer tube. A port larger in diameter than the lower material transfer tube allows heat from the combustion chamber to contact the vertical material transfer tube.

Another recent improvement in melter kettle efficiency developed by the present inventor is disclosed in U.S. non-provisional patent application Ser. No. 15/424,455, entitled THERMOPLASTIC KETTLE OIL BATH AUXILIARY HEAT EXCHANGER SYSTEM, filed Feb. 3, 2017. This invention combines an odd number of interconnected vertical tubes within an oil bath through which heated heat transfer oil flows. The function of the system is to increase the temperature of molten thermoplastic material moving through the circuit of interconnected heat transfer tubes by action of an independent high BTU output furnace that heats circulated heat transfer oil that circulates around the interconnected tubes. Molten thermoplastic material enters the base of the first tube through a melter kettle bottom material flow port and the tube bottom material flow port both of which are isolated from the oil bath. The molten thermoplastic material reenters the melter kettle at the top center through the top flow tube that connects to the top of the discharge tube that is above the level of the melter kettle top and is isolated from the oil bath. Each tube contains an auger.

The augers are interconnected by a gear train. A single hydraulic motor attached to any auger drives each gear and auger in a counter rotational direction. This circulates the molten thermoplastic material from the bottom of the melter kettle where it is hottest through the melter kettle bottom material flow port into the bottom of the first tube then up and down the plurality of tubes. The material flows up the last tube and through a tube top port which is isolated from the oil bath and through the top material flow tube located at a level above the top of the melter kettle fill line. The molten thermoplastic material is deposited near the top center of the melter kettle where it heats and displaces downward the thermoplastic material at the surface of the melter kettle. The heat transfer enters the oil bath tub adjacent the thermoplastic material discharge port where both the oil and thermoplastic material are at their hottest temperature and is directed through and leaves the system adjacent the thermoplastic material inlet port where it is heat depleted. When the system is disengaged and circulation ceases the hydraulic motors are run in a reverse direction to purge as much thermoplastic material from all tubes except for the inlet tube. This will leave solid material in only the first tube so that when the system is restarted it will take less heat and hydraulic energy to engage the system and begin moving molten thermoplastic material.

There is a limit to the various available energy outputs of mobile equipment systems that can be incorporated in thermoplastic equipment such as heat, electrical, engine, hydraulic, air and other systems. Some serious drawbacks to thermoplastic oil bath auxiliary heat exchanger systems are that they require a separate high BTU boiler system, separate hot oil circuits as well as oil expansion chambers designed with exotic heat transfer oils some of which require inert gas blanket interfacing. The high output boilers required need more space than is available on most thermoplastic application trucks. Motors to run the hydraulics and oil circulation systems are subject to space limitations. Weight is also a serious consideration. For each pound that the system weighs the load carrying capacity is reduced by a similar amount. Costs are high for all of the system components.

Another recent improvement in melter kettle efficiency that has been developed by the present inventor is disclosed in U.S. non-provisional patent application Ser. No. 15/424,467, entitled THERMOPLASTIC KETTLE AUXILIARY HEAT EXCHANGER SYSTEM filed Feb. 3, 2017. This system is a design that allows a plurality of interconnected tubes to be used like those in copending non-provisional application Ser. No. 15/424,455 where the plurality of tubes are within the heat chamber and not an oil bath. This eliminates the need for additional furnaces, pumps, hydraulic systems and an oil bath chamber that are required in the oil bath invention in copending non-provisional application Ser. No. 15/424,455. The interconnected plurality of tubes with auger assemblies is connected directly to the inner wall of the heat chamber. The inlet is at the bottom of the first tube's intake port and the outlet is at the top of the top of the last tube's outlet port above the fill line of the melter kettle.

There is a critical difference in both design and function of the oil bath auxiliary heat exchanger and the heat chamber auxiliary heat exchanger. In an oil bath system the thermoplastic material can never go above the temperature of the heat transfer oil. The heat transfer oil's highest operation temperature cannot exceed the baking/degradation temperature of the thermoplastic material. Therefore the oil bath system is a failsafe system with respect to the temperature at which thermoplastic material is heated. In non-oil bath heating systems the heat chamber can exceed the baking/degradation temperature of the thermoplastic material. To prevent baking/degradation in the heat chamber system special procedures must be followed. The thermoplastic material must be constantly moving through the system during operation. At shut down the thermoplastic material must continue circulating until the melter kettle and tube walls drop below a safe temperature. It may be necessary to add ambient temperature material to the melter kettle to draw down the heat on the melter kettle and tube walls. The direction of flow in the tubes must never be reversed until a safe temperature is reached or the augers may be frozen in place.

The present invention provides an improvement for melter kettles used for melting thermoplastic pavement marking material wherein the melter kettle is provided with a combustion chamber the improvement comprising an auxiliary tube bundle multi-pass tube bundle exchanger (also referred to herein as a multi-pass tube bundle thermoplastic pavement marking material heat exchanger) wherein molten thermoplastic pavement marking material enters a bottom inlet in the auxiliary multi-pass tube bundle heat exchanger from a corresponding bottom outlet of the melter kettle bottom and through a connecting transfer tube. The auxiliary multi-pass tube bundle heat exchanger has an odd numbered multi-pass assembly that allows the molten thermoplastic material to circulate such that it exits the last vertical section through a top outlet of the heat exchanger to a corresponding top inlet of the melter kettle through a top connecting transfer tube. Movement of the molten thermoplastic material from the melter kettle, through the auxiliary multi-pass tube bundle heat exchanger and back into the melter kettle is achieved by means of any type of pump suitable for the purpose.

A hot oil circulation system coupled to the auxiliary multi-pass tube bundle heat exchanger heats the thermoplastic material flowing through the auxiliary multi-pass tube bundle heat exchanger by heat transfer across the tube walls and into the thermoplastic material. The hot oil circulation system includes a high BTU output oil furnace with temperature controls, a pump designed to circulate the oil through the circuit and flow lines. The heated oil is pumped from the furnace through the flow lines connected to the oil inlet port of the auxiliary multi-pass tube bundle heat exchanger located at the top of the auxiliary multi-pass tube bundle heat exchanger just below the top of the tube bundle terminus wherein it circulates downward and exits the oil outlet port just above the bottom bundle terminus. The heat depleted oil returns through the return flow lines back to the furnace where it is reheated and returned to the hot oil pump.

BRIEF SUMMARY

According to various features, characteristics and embodiments of the present invention which will become apparent as the description thereof proceeds, the present invention provides an auxiliary multi-pass tube bundle heat exchanger in combination with a melter kettle for melting thermoplastic pavement marking material wherein the melter kettle wherein the auxiliary multi-pass tube bindle heat exchanger comprises:

a bundle of heat transfer tubes through which thermoplastic material flows and around which hot heat transfer oil flows;

a shell that houses the bundle of heat transfer tubes;

a top cap at a top of the auxiliary multi-pass tube bundle heat exchanger and a bottom cap at a bottom of the auxiliary multi-pass tube bundle heat exchanger;

a top chamber above a top of the bundle of heat transfer tubes; and a bottom chamber below a bottom of the bundle of heat transfer tubes, wherein a flow direction of molten thermoplastic material through the auxiliary multi-pass tube bundle heat exchanger is reversed in at least one of the top chamber and the bottom chamber.

The present invention also provides a method of melting a thermoplastic material in a melter kettle having a lower combustion chamber and a heat chamber surrounding the melter kettle, said method comprising:

charging thermoplastic material into the melter kettle;

combusting a fuel source in the combustion chamber to heat and melt the thermoplastic material in the melter kettle;

providing an auxiliary multi-pass tube bindle heat exchanger comprises:

a bundle of heat transfer tubes through which thermoplastic material flows and around which hot heat transfer oil flows;

a shell that houses the bundle of heat transfer tubes;

a top cap at a top of the auxiliary multi-pass tube bundle heat exchanger and a bottom cap at a bottom of the auxiliary multi-pass tube bundle heat exchanger;

a top chamber above a top of the bundle of heat transfer tubes; and a bottom chamber below a bottom of the bundle of heat transfer tubes, passing hot heat transfer oil around the heat transfer tubes; and transporting molten thermoplastic material from the bottom of the melter kettle through the auxiliary multi-pass tube bundle heat exchanger and into the top of the melter kettle.

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

Figure 1:
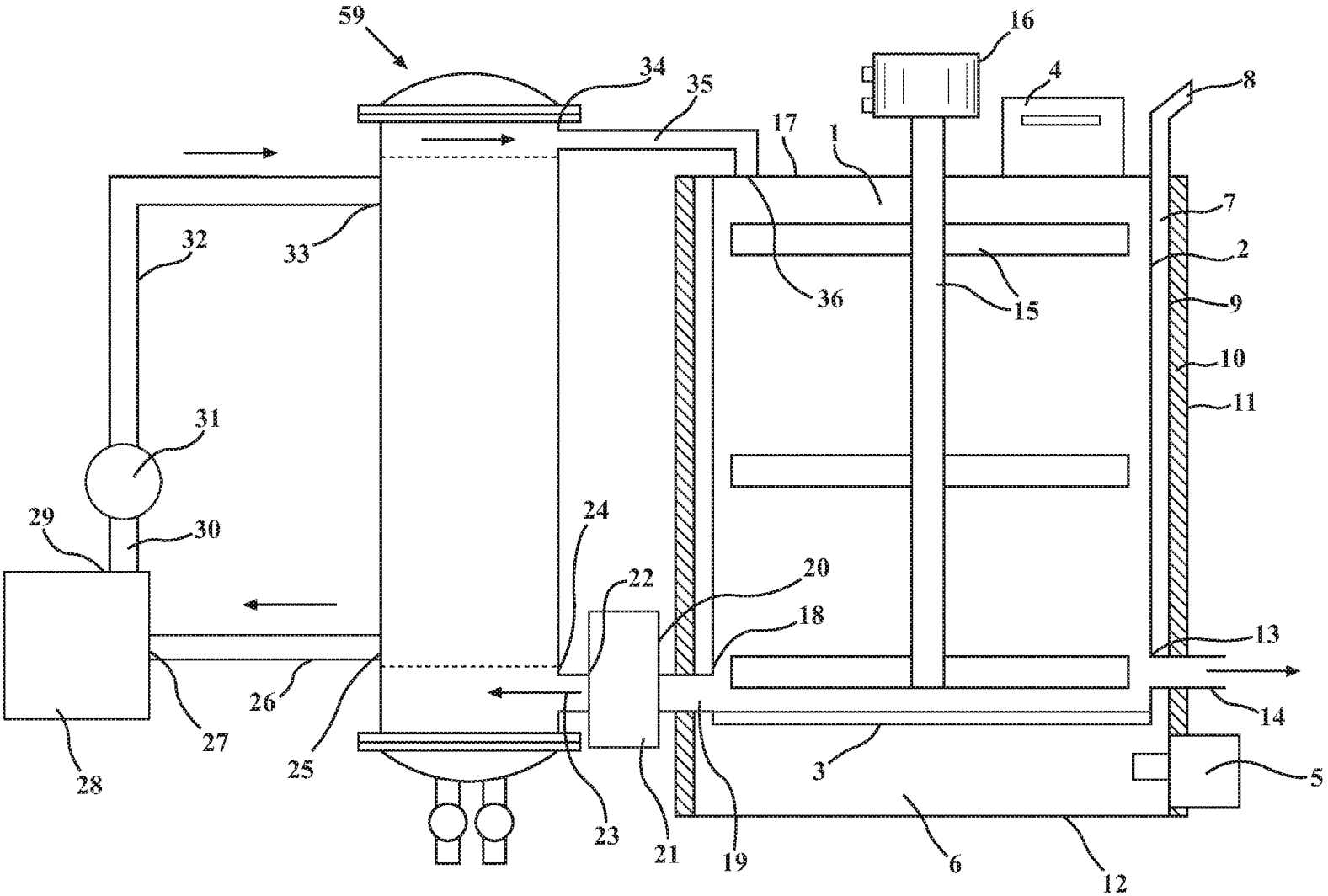
FIG. 1 is a cut away side view of an air jacket thermoplastic melter kettle couple to an auxiliary multi-pass tube bundle thermoplastic pavement marking material heat exchanger according to one embodiment of the present invention.

An object of the present invention is to reduce the melting time of thermoplastic pavement marking material melted in melter kettles that may be stationary, mounted on support trucks, support trailers or on truck mounted thermoplastic application vehicles where the vehicle is the applicator. It has been long recognized that the rate of melting thermoplastic material in melter kettles has not been able to keep up with improvements in application equipment that have increased the rate at which thermoplastic material can be applied. While the methods of application and equipment development have increased the rate of application, production melting capacity has recently lagged far behind the ability to apply the material.

The present invention is based upon the recognition that increasing the heat exchange surface area within a melter kettle to which a thermoplastic material within the melter kettle comes into contact and providing a separate heat source to heat the additional heat exchange surface will increase the rate of melting of thermoplastic material within the melter kettle. The present invention takes advantage of the fact that there is a temperature gradient between thermoplastic material flowing through applicant's auxiliary multi-pass tube bundle thermoplastic heat exchanger tubes and the heat transfer oil that passes through the auxiliary multi-pass tube bundle heat exchanger and around the heat exchanger's tubes. The present invention can take advantage of and use newer heat transfer oils which have been developed that can be heated to much higher temperatures than heat transfer oils that are currently used in heat transfer systems on application trucks to melt thermoplastic materials in conjunction with oil jacketed thermoplastic flow lines, pumps, filters, application guns that are used in complete circuit systems from melter kettles to the exit of the application guns. The new higher temperature heat transfer oils can function at increased temperatures of 150° F. or more thereby greatly increasing the rate of heat exchange between the heat transfer oil and the molten thermoplastic material flowing through applicant's auxiliary multi-pass tube bundle heat exchanger tubes. Applicant's current system disclosed herein is more efficient than heat domes, and each of applicant' co-pending non-provisional applications disclosed above. However any or all of applicant' systems disclosed in these copending non-provisional applications can be combined with the present invention and will further reduce melting time and are hereby expressly incorporated by reference.

The present invention increases the rate of melting thermoplastic pavement marking material by increasing the heat differential between the application temperature of the medium that transfers heat across tube bundle heat exchanger tubes in the auxiliary multi-pass tube bundle heat exchanger as compared to previous systems. Further the present invention provides an upper interface and a lower interface chamber whereby molten thermoplastic pavement marking material enters and exits these respective chambers allowing for removal of the top and bottom caps and access and servicing the auxiliary multi-pass tube bundle heat exchanger without disconnecting the thermoplastic material flow lines. Furthermore the bottom cap is ported and joined by a valve in each of its two compartmented chambers to allow for emptying all three groups of heat transfer tubes of the auxiliary multi-pass tube bundle heat exchanged to prevent clogging.

According to the present invention the thermoplastic material in a melter melter kettle is heated and melted to have a viscosity which will allow it to enter the intake port of the auxiliary multi-pass tube bundle heat exchanger from the base of the melter kettle where it is hottest. Then the heated, molten thermoplastic material moves through the multi-pass tube bundle circuit by action of a pump to the outlet port at the top of the outlet chamber from where it passes through a connector to a melter kettle top port above the fill line of the melter kettle.

Another aspect of this invention is based upon dynamic heat exchange. The action of heating thermoplastic material by moving relatively hot thermoplastic material from the bottom of the melter kettle to the top of the melter kettle where material is added is considered passive. The heat exchange system of the present invention is also a dynamic system whereby heat transfer oil is heated by a high BTU output furnace well above that of the temperature required to apply thermoplastic material and is circulated by a hot oil pump through a dedicated hot oil circuit and through an auxiliary multi-pass tube bundle heat exchanger tube bundle chamber. The heat is transferred from the heat transfer oil across the tube walls and into the molten thermoplastic pavement marking material. A pump with adequate force moves the molten thermoplastic material from the melter kettle bottom outlet port into, through and out of the heat exchanger at the top discharge port that connects to the melter kettle inlet that is above the fill level.

FIG. 1 is a cut away side view of an air jacket thermoplastic melter kettle couple to an auxiliary multi-pass tube bundle thermoplastic pavement marking material heat exchanger according to one embodiment of the present invention.

Melter kettle 1 has an internal chamber that is defined between the melter kettle side wall 2, melter kettle bottom 3, and top of the melter kettle that is closed by lid 17 in FIG. 1. Pavement marking thermoplastic material in either granular or solid form is added into the melter kettle melting chamber through fill chute 4 that is provided with a conventional safety splash back preventer (not shown) to protect the material handler from burns. A diesel-fired or other type of burner unit 5 is attached to the outside of the melter kettle adjacent to combustion chamber 6 to provide the heat energy required to heat the thermoplastic material in the melter kettle to a molten state and maintain it at the correct application temperature. External air is introduced at the burner unit 5 to allow for combustion. The heated combustion air within the combustion chamber acts upon the melter kettle bottom 3 first then flows towards the outside of the melter kettle wall 2 where it enters and travels up through annular heat exchange chamber 7 and exhausts the system through exhaust stacks 8. It is this action that defines the system in FIG. 1 as an air jacket melter kettle.

A temperature gradient is created between the melter kettle bottom 3 where the temperature is the hottest and the top most point on the melter kettle side wall 2 where the temperature is coolest. Heat transfer is most efficient at the hottest point of the melter kettle bottom and loses efficiency adjacent the upper portions of the melter kettle wall 2. The annular heat exchange chamber 7 is surrounded by an outer heat chamber/inner insulation chamber wall 9 and insulation chamber 10 in which there is insulation shielding the external surface from radiant heat. An outer insulation skin 11 of the surrounds insulation chamber 10. The melter kettle assembly base 12 also contains insulation and provides support for the structure.

Molten thermoplastic material exits the melter kettle shown in FIG. 1 through a bottom melter kettle weldment port 13 and bottom weldment transfer tube 14 to the application equipment. Molten thermoplastic material within the melter kettle melting chamber is mixed by an agitator assembly 15 that is controlled by a counter rotating motor 16. The melter kettle lid 17 connects and supports the melter kettle wall assemblies in place.

FIG. 1 shows the molten thermoplastic material flow circuit from the melter kettle bottom to the bottom inlet of the auxiliary multi-pass oil bath tube bundle heat exchanger 59 (see FIG. 2 and FIG. 3) and from the top outlet of the auxiliary multi-pass oil bath tube bundle heat exchanger to the melter kettle top inlet.

Molten thermoplastic material is transferred by thermoplastic material transfer pump 21 from the bottom of melter kettle 1 where the thermoplastic material is the hottest through the auxiliary heat exchanger weldment port 18 and through the bottom transfer tube 19 and into the intake 20 of the thermoplastic material transfer pump 21. The thermoplastic material transfer pump 21 forces the molten thermoplastic material through the pump outlet port 22 and through the pump outlet transfer tube 23 and into the auxiliary multi-pass tube bundle heat exchanger at the bottom of auxiliary heat exchanger weldment intake port 24. The molten thermoplastic material, being under pressure developed by transfer pump 21, flows through the circuit of the heat exchanger shown in FIG. 2 and exits at the top auxiliary multi-pass tube bundle heat exchanger exit weldment port 34 and flows through the auxiliary multi-pass tube bundle heat exchanger outlet transfer tube 35 and into the melter kettle through the melter kettle top inlet port 36 depositing hot molten thermoplastic material at the top of the melter kettle chamber.

Heat depleted transfer oil exits the auxiliary multi-pass tube bundle heat exchanger at the bottom of the tube bundle through the bottom oil outlet port weldment 25 and flows through the heat depleted oil return line 26 to the intake port 27 of the heat transfer oil furnace 28 wherein it is heated. Heated heat transfer oil exits the heat transfer oil furnace 28 at the furnace outlet port 29 through flow line 30 to hot oil circulation pump 31. The hot heat transfer oils is pumped through pump outflow line 32 and enters the top of the auxiliary multi-pass tube bundle heat exchanger through the tube bundle oil inlet port weldment 33.

Figure 2:
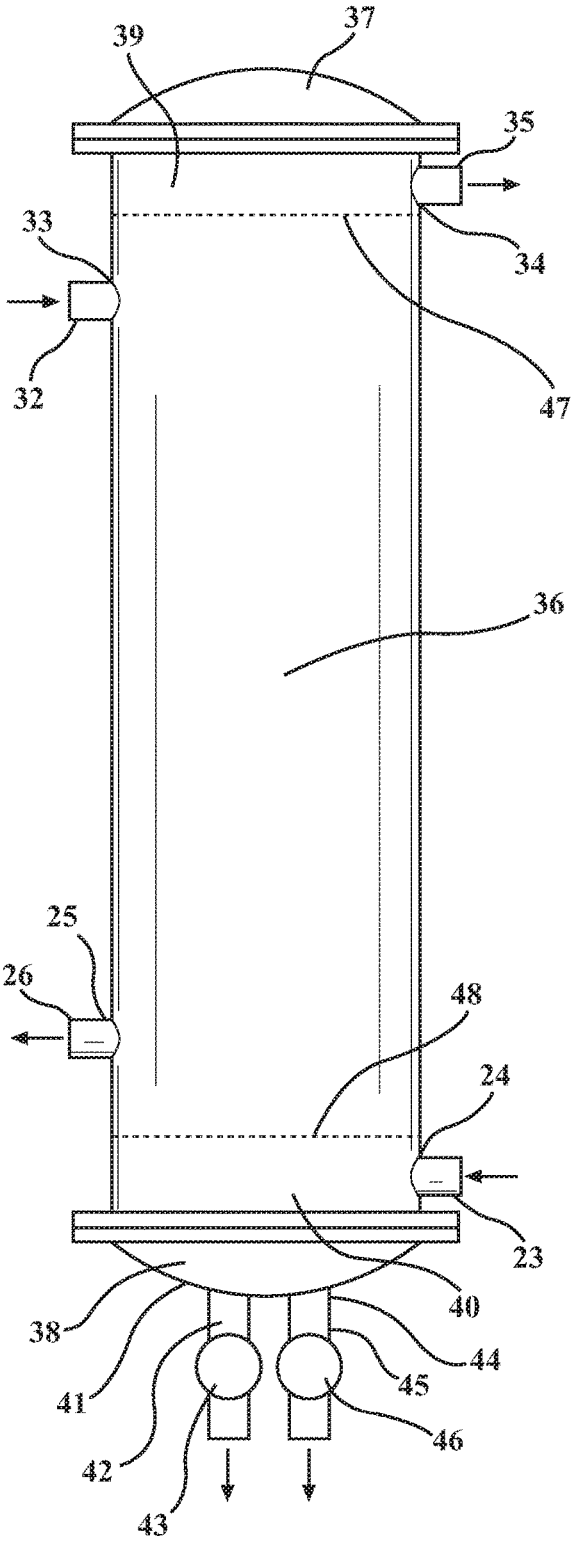
FIG. 2 is a side view of the auxiliary multi-pass tube bundle thermoplastic pavement marking material heat exchanger configured in series with the heating oil/molten thermoplastic circuits.

FIG. 2 is a side view of the multi-pass tube bundle thermoplastic pavement marking material heat exchanger configured in series with the heating oil/molten thermoplastic circuits.

As discussed above in reference to FIG. 1 the molten thermoplastic material enters the auxiliary multi-pass tube bundle heat exchanger through bottom heat exchanger thermoplastic material inlet weldment 24 and the bottom heat exchanger thermoplastic material transfer tube 23 and exits the auxiliary multi-pass tube bundle heat exchanger through the multi-pass oil bath heat exchanger exit weldment port 34 and heat exchanger outlet transfer tube 35.

Also shown in FIG. 2 is the bottom heat transfer oil weldment 25 through which heat depleted heat transfer oil exits the auxiliary multi-pass tube bundle heat exchanger and flows out through the heat depleted oil return line 26. The heated heat transfer oil enters the top tube bundle through the top tube bundle weldment port 33 from the pump outflow line 32.

The thermoplastic melter kettle auxiliary multi-pass tube bundle heat exchanger of the present invention has a tube steel shell 36 and a top cap 37. The auxiliary multi-pass tube bundle heat exchanger of the present invention is configured to use thermoplastic pavement marking material that contains a high concentration of glass beads for reflective purposes. Such glass beads can settle out during cooling of the molten thermoplastic material. Accordingly if there was no way to prevent the glass beads from settling out upon cooling the operation of the system would become adversely effected. To solve this problem the auxiliary multi-pass tube bundle heat exchanger of the present invention is provide with a bottom cap 38 that includes two threaded ports each with a NPT nipple and valve. A screwed nipple 42 provided with a 43 attached to threaded port 41. Another screwed nipple 45 provided with a valve 46 is attached to threaded port 44. One of the valves will drain one of the three tube bundle columns (described below) of material and the other will drain the remaining two tube bundle columns in a three pass system. After completion of applying thermoplastic material to a pavement surface, valves 43 and 46 can be opened to drain the system of thermoplastic material while it is still molten and any glass beads that have settled out thereby preventing clogging upon thermoplastic material cooling and glass bead settlement. The top and bottom caps 37 and 38 are shown as having flanges through which mechanical fasteners (not shown) can be inserted to attached the top and bottom caps 37 and 38 to the shell 36.

In order to minimize space on an application vehicle the material line 23 leading to the heat exchanger weldment port 24 and the material line 35 leading from the heat exchanger weldment port 34 are kept short. However such a provision limits working room which would otherwise be necessary to allow for easy removal of the auxiliary tube bundle heat exchanger to service the same. To solve this problem the present inventor has incorporated an open chamber 39 above the top tubesheet 47 and below the top cap 37 and an open chamber below the bottom tubesheet 48 and above the bottom cap 38. Molten thermoplastic material enters the auxiliary multi-pass tube bundle heat exchanger through inlet weldment port 24 into the bottom open chamber which is above the bottom cap 38 and below the bottom tubesheet 48. Molten thermoplastic material exits the auxiliary multi-pass tube bundle heat exchanger through outlet weldment port 34 from the top open chamber 39 which is above the top tubesheet 47 and below the top cap 37. This configuration allows the auxiliary multi-pass tube bundle heat exchanger to be serviced by removing only the top and bottom caps 37 and 38 which saves time and makes servicing a simple task.

Figure 3:
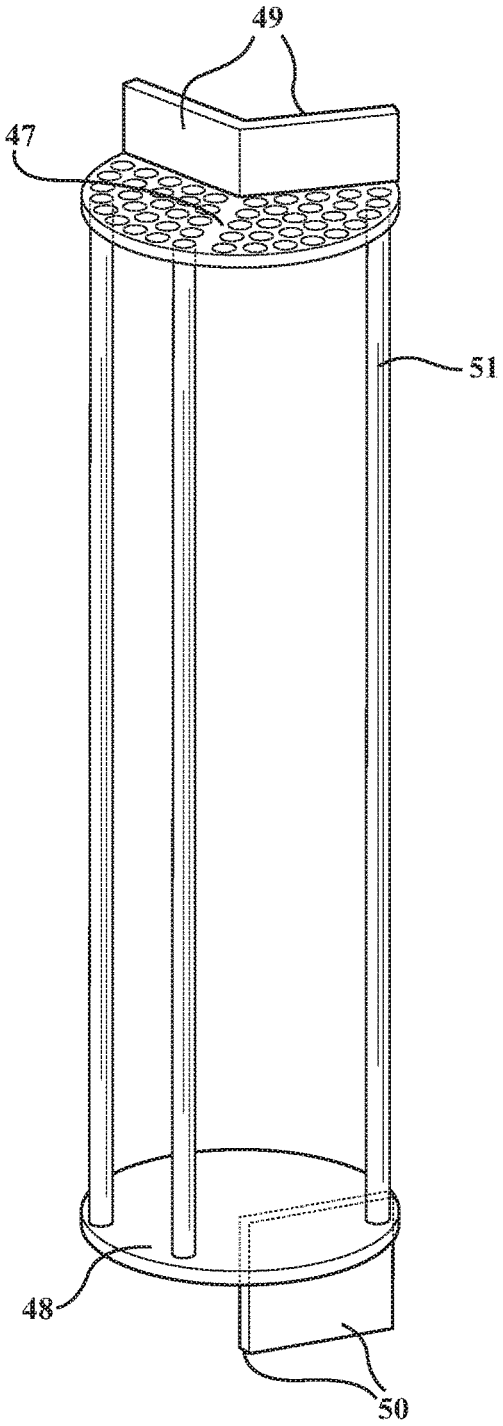
FIG. 3 is a partially cut-away side view of the auxiliary multi-pass tube bundle thermoplastic pavement marking material heat exchanger according to one embodiment of the present invention.

FIG. 3 is a partially cut-away side view of the auxiliary multi-pass tube bundle thermoplastic pavement marking material heat exchanger according to one embodiment of the present invention. The auxiliary multi-pass tube bundle heat exchanger shown in FIG. 3 is a three pass oil bath heat exchanger system drawn to show only a few heat transfer tubes which are coupled to and extend between the top tubesheet 47 and the bottom tubesheet 48. Top tubesheet 47 has welded or otherwise connected to it the extended partition walls 49 that extend into the top chamber 39 from which molten thermoplastic material flows out of the unit. Bottom tubesheet 48 has welded or otherwise connected to it the extended partition walls 50 that extend into the bottom chamber 40 into which molten thermoplastic material flows into the unit. A representative number of heat transfer tubes 51 are as shown.

Figure 4:
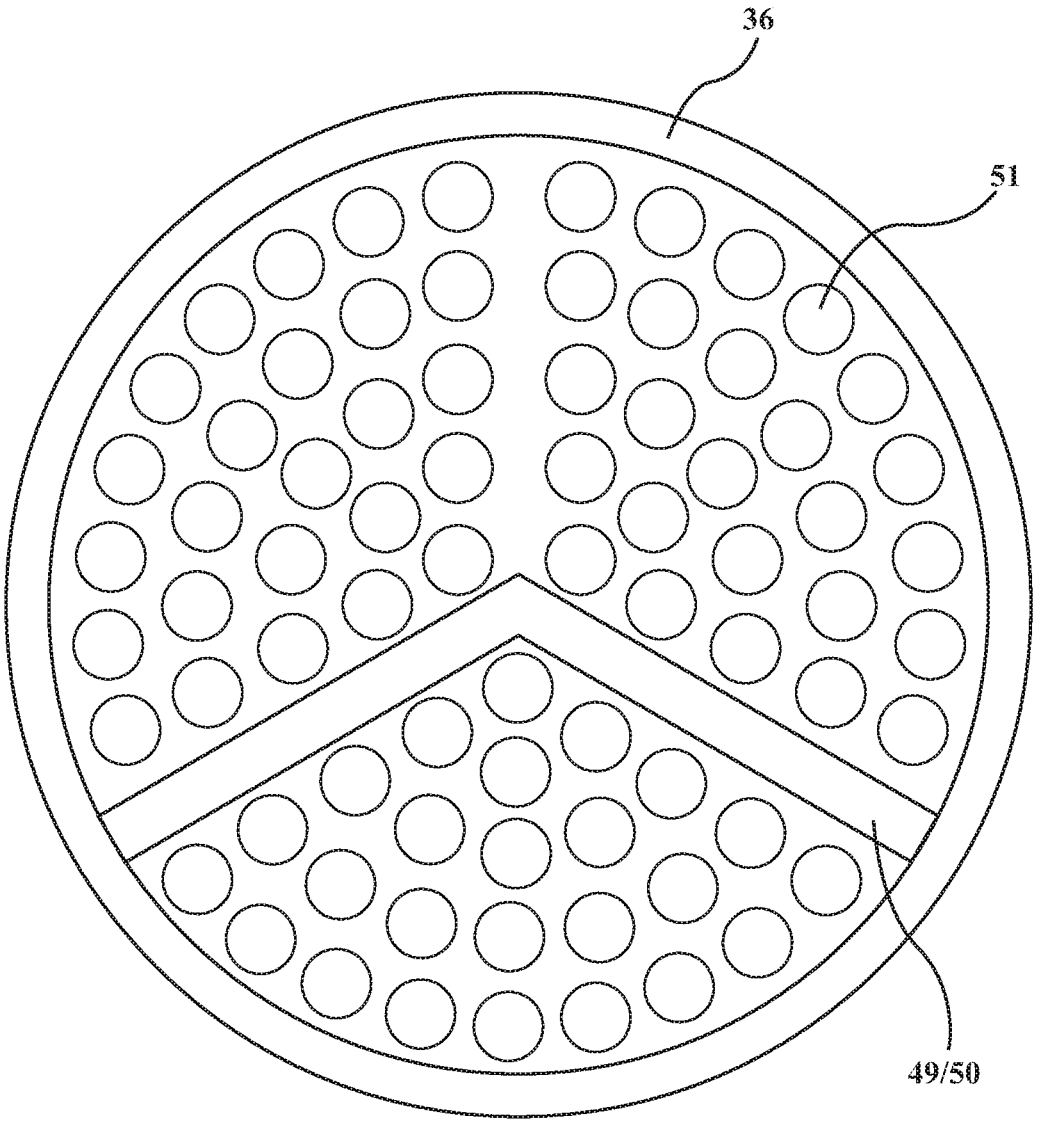
FIG. 4 is a cross-sectional view of an auxiliary multi-pass tube bundle thermoplastic material tube assembly according to one embodiment of the present invention.

FIG. 4 is a cross-sectional view of an auxiliary multi-pass tube bundle thermoplastic material tube assembly according to one embodiment of the present invention. The tube assembly shown in FIG. 4 extends between top tubesheet 47 and bottom tubesheet and includes shell 36 that defines the outer wall of the tube assembly and a number of heat transfer tubes 51. Since the auxiliary multi-pass tube bundle thermoplastic material tube assembly is a three pass system the heat transfer tubes are show as being arranged in three groups that are separated by radial gaps which are configured to be aligned with the extended top and bottom tubesheet partitions 49 and 50 as discussed below. From the discussion below it can be understood that while 75 heat transfer tubes 51 are shown fewer or more heat transfer tubes 51 can be used. Further while a three pass auxiliary multi-pass tube bundle heat exchanger is described other odd number of passes can be used together with complementary extended partitions. Further an even number or passes can be configured by providing both the inlet and outlet from and to the melter kettle in communication with the lower chamber which has a suitable extended partition(s).

Figure 5:
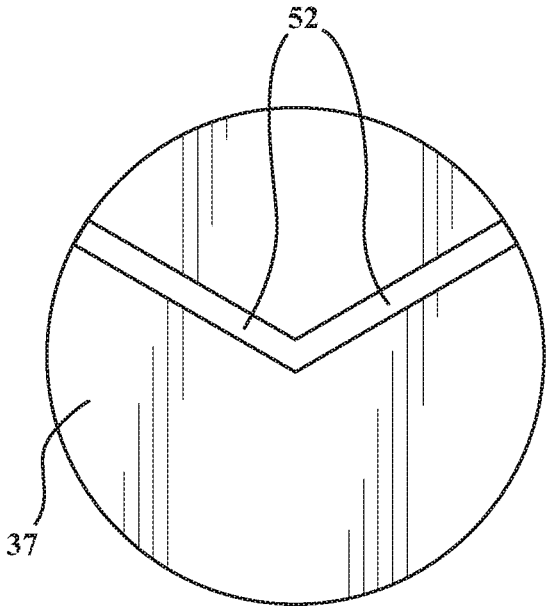
FIG. 5 is bottom view of the top thermoplastic heat exchanger cap showing the extended partitions.

FIG. 5 is a bottom view of the top thermoplastic heat exchanger cap showing the extended partitions.

Figure 6:
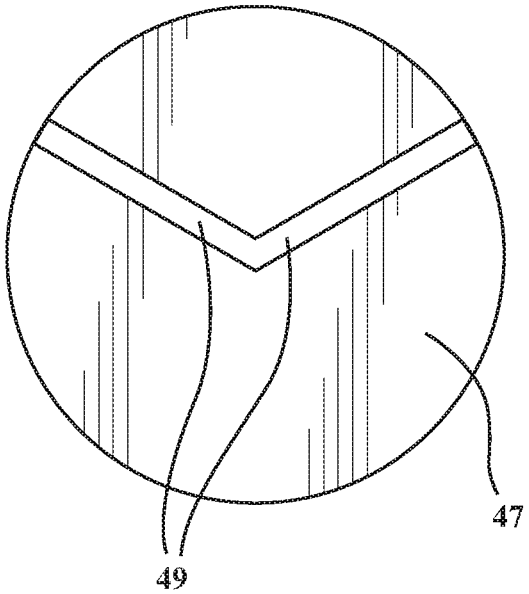
FIG. 6 is a top view looking down on the top tubesheet showing the extended partitions that are aligned with the partitions in the top cap.

FIG. 6 is a top view looking down on the top tubesheet showing the extended partitions that are aligned with the partitions in the top cap.

Figure 7:
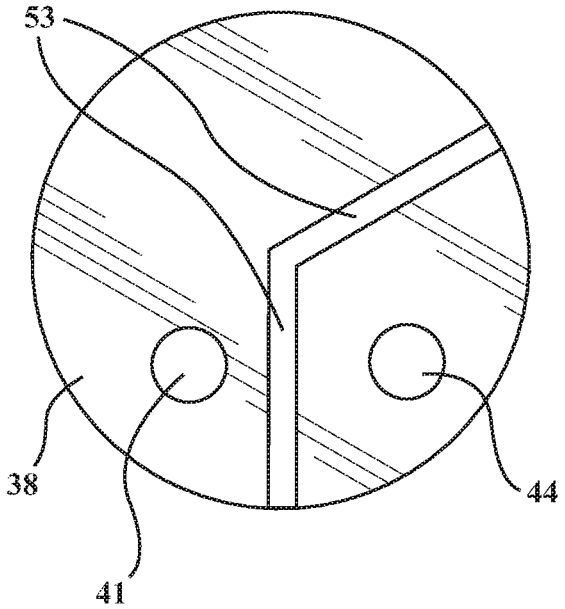
FIG. 7 is a top view of the bottom thermoplastic heat exchanger cap showing the directional flow chamber partitions.
Figure 8:
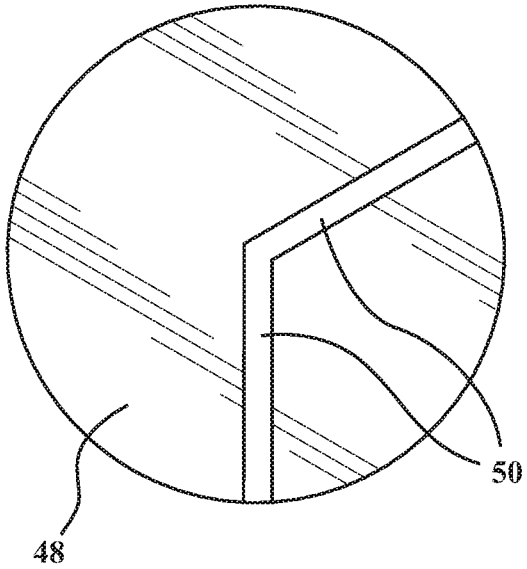
FIG. 8 is a bottom view looking up on the bottom tubesheet showing the extended partitions that are aligned with the partitions in the bottom cap.

FIG. 7 is a top view of the bottom thermoplastic heat exchanger cap showing the extended partitions FIG. 8 is a bottom view looking up on the bottom tubesheet showing the extended partitions that are aligned with the partitions in the top cap The partitions and extended partitions reverse flow direction of the molten thermoplastic material when it enters the chambers in the top and bottom 39 and 40 at the top and bottom of the auxiliary multi-pass tube bundle thermoplastic material tube assembly.

The partitions 52 and 53 extend from the inner walls of the top cap 37 and bottom cap 38 and are flush with the planes of the caps so as to seals tight against the extended partitions 49 and 50 provided on the tubesheets 47 and 48. A seal gasket can be provided between both the top and bottom caps 37 and 38 and top and bottom of the shell 36, as well as between the partitions 52 and 53 and the extended partitions 49 and 50.

In the three pass auxiliary multi-pass tube bundle heat exchanger threaded port 44 is located in the inflow partition (⅓ of the tubes) of the lower chamber 40. Threaded port 41 is located in the chamber common to the outflow chamber partition (⅔ of the tubes) in the lower chamber 40. Additional ports and partitions and extended partitions can be provided in other than three pass system configurations.

Figure 9:
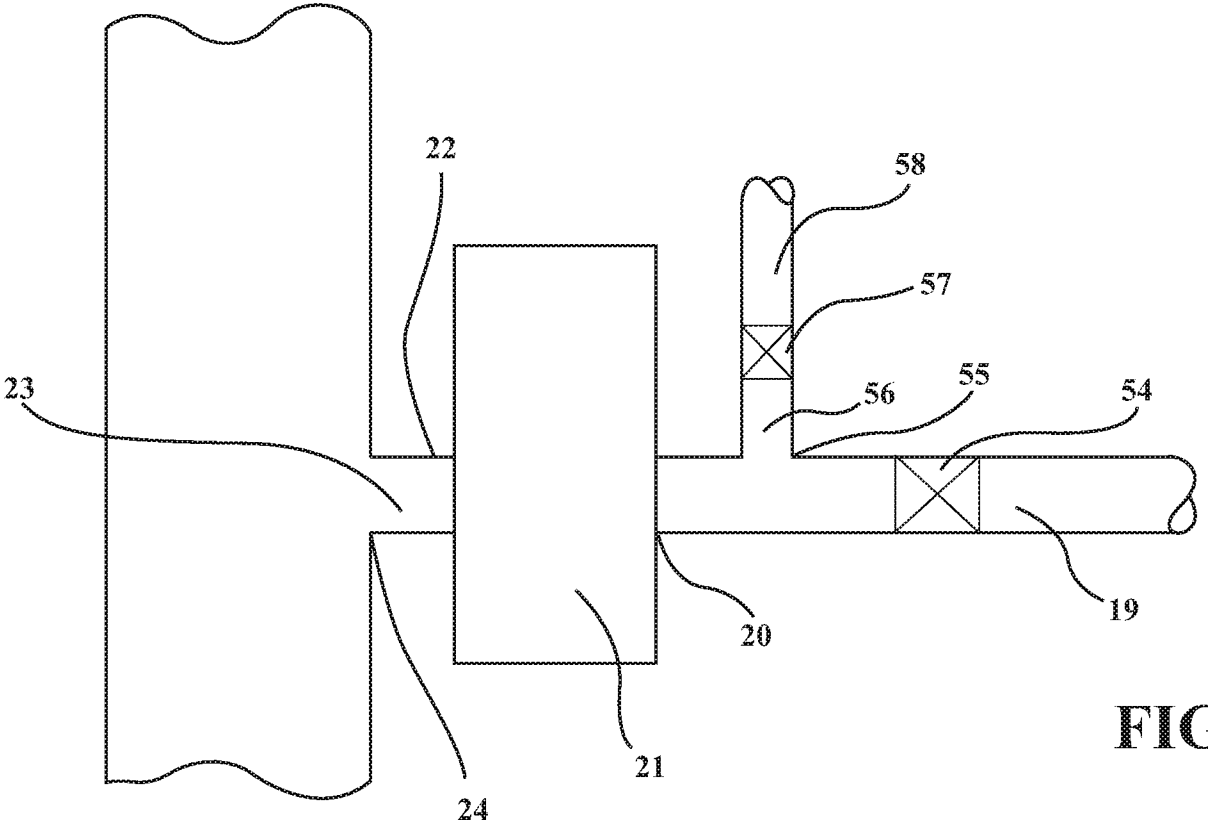
FIG. 9 is a cross-sectional view of a material purge system according to one embodiment of the present invention.

FIG. 9 is a cross-sectional view of a material purge system according to one embodiment of the present invention.

The material purge system is designed to purge the auxiliary multi-pass tube bundle heat exchanger of molten thermoplastic material after use. As shown in FIG. 9 a valve 54 in provided in the pump inlet tube 19 and can be used to shut off the flow of molten thermoplastic material into pump 21. A nipple 56 is teed into pump inlet tube 19 between valve 54 and pump 21 at attachment point 55 which is upstream of thermoplastic material inlet port 20. Nipple 56 is connected to air line 58 and includes an air valve 57. To purge the auxiliary multi-pass tube bundle heat exchanger valve 54 is shut off to stop the flow of molten thermoplastic material to pump 21. Next valve 57 is open so as to allowing air from the compressor (not shown) through air line 58 and though pump 21 and the auxiliary multi-pass tube bundle heat exchanger so as to force molten thermoplastic material through the exchanger's heat transfer tube circuit and into the melter kettle at inlet port 36.

While the auxiliary multi-pass tube bundle heat exchanger is show in the drawings as having a circular tubular shape in other embodiments the shape of the auxiliary multi-pass tube bundle heat exchanger can be other than circular and tubular.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. An auxiliary multi-pass tube bundle heat exchanger in combination with a melter kettle containing molten thermoplastic pavement marking material for melting the thermoplastic pavement marking material in the melter kettle wherein the auxiliary multi-pass tube bundle heat exchanger comprises:

a bundle of heat transfer tubes through which thermoplastic material flows and around which hot heat transfer oil flows;

a shell that houses the bundle of heat transfer tubes;

a top cap at a top of the auxiliary multi-pass tube bundle heat exchanger and a bottom cap at a bottom of the auxiliary multi-pass tube bundle heat exchanger;

a top chamber above a top of the bundle of heat transfer tubes; and a bottom chamber below a bottom of the bundle of heat transfer tubes, wherein a flow direction of molten thermoplastic material through the auxiliary multi-pass tube bundle heat exchanger is reversed in at least one of the top chamber and the bottom chamber, and the bottom cap is provided with ports to drain molten thermoplastic material from the auxiliary multi-pass tube bundle heat exchanger, wherein the auxiliary multi-pass tube bundle heat exchanger includes a thermoplastic material inlet that is coupled to the bottom chamber and a thermoplastic material outlet that is coupled to the top chamber.

2. An auxiliary multi-pass tube bundle heat exchanger in combination with a melter kettle according to claim 1, wherein flow directing partitions are provided in the top and bottom chambers.

3. An auxiliary multi-pass tube bundle heat exchanger in combination with a melter kettle according to claim 2, wherein some of the flow directing partitions extend inside the top chamber and others of the flow directing partitions extend inside the bottom chamber.

4. An auxiliary multi-pass tube bundle heat exchanger in combination with a melter kettle according to claim 1, wherein the bundle of heat transfer tubes include upper and lower tubesheets to which upper and lower ends of the heat transfer tubes are attached, the tubesheets containing the hot heat transfer oil to flow around the heat transfer tubes between the upper and lower tubesheets.

5. An auxiliary multi-pass tube bundle heat exchanger in combination with a melter kettle according to claim 1, wherein the hot heat transfer oils flows from an upper to a lower portion of the auxiliary multi-pass tube bundle heat exchanger and the molten thermoplastic material flows from a lower to an upper portion of the auxiliary multi-pass tube bundle heat exchanger.

6. An auxiliary multi-pass tube bundle heat exchanger in combination with a melter kettle according to claim 1, wherein the ports to drain molten thermoplastic material include valves.

7. An auxiliary multi-pass tube bundle heat exchanger in combination with a melter kettle according to claim 1, further comprises a pump for causing molten thermoplastic material to flow from the melter kettle to the auxiliary multi-pass tube bundle heat exchanger.

8. An auxiliary multi-pass tube bundle heat exchanger in combination with a melter kettle according to claim 7, further comprising a purge line coupled to the pump for supplying compressed air to the pump to purge molten thermoplastic material from the auxiliary multi-pass tube bundle heat exchanger and pump.

9. An auxiliary multi-pass tube bundle heat exchanger in combination with a melter kettle according to claim 1, further comprising a heat transfer oil furnace and hot oil circulation pump coupled to the auxiliary multi-pass tube bundle heat exchanger to pass hot oil around the heat transfer tubes.

10. An auxiliary multi-pass tube bundle heat exchanger in combination with a melter kettle according to claim 1, wherein the auxiliary multi-pass tube bundle heat exchanger is a three-pass tube bundle heat exchanger.

11. An auxiliary multi-pass tube bundle heat exchanger in combination with a melter kettle according to claim 2, wherein auxiliary multi-pass tube bundle heat exchanger is a three-pass tube bundle heat exchanger and the flow directing partitions in the top and bottom chambers divide each of the top and bottom chambers into two sections.

* * * * *